United States Patent [19]

Kenyon, 2nd.

[11] Patent Number: 4,782,976

[45] Date of Patent: Nov. 8, 1988

[54] TAMPER-EVIDENT CANISTER, LID AND SHRINK BAND ASSEMBLY

[75] Inventor: Maynard A. Kenyon, 2nd., Hamilton Square, N.J.

[73] Assignee: General Foods Corporation, White Plains, N.Y.

[21] Appl. No.: 178,729

[22] Filed: Apr. 7, 1988

[51] Int. Cl.[4] ..... B65D 41/18

[52] U.S. Cl. ..... 220/306; 206/508; 215/246

[58] Field of Search ..... 215/246, 10; 220/306, 220/319; 206/508

[56] References Cited

U.S. PATENT DOCUMENTS

| | | | |
|---|---|---|---|
| Re. 24,889 | 10/1960 | Tupper | 150/0.5 |
| 2,074,325 | 3/1937 | Carew | 229/5.5 |
| 3,955,705 | 5/1976 | Dubois et al. | 220/67 |
| 4,014,459 | 3/1977 | Robinson | 220/380 |
| 4,037,748 | 7/1977 | Stubbs, Jr. | 215/256 |
| 4,079,857 | 3/1978 | Crisci | 220/306 |
| 4,421,244 | 12/1983 | Van Melle | 220/306 |
| 4,443,896 | 4/1984 | Porat et al. | 4/144.1 |
| 4,512,493 | 4/1985 | Von Holdt | 206/508 X |
| 4,538,740 | 9/1985 | Petersen, Jr. | 215/246 |
| 4,669,630 | 6/1987 | Kenyon, 2nd. | 220/276 |

*Primary Examiner*—Donald F. Norton

*Attorney, Agent, or Firm*—Thomas R. Savoie; Daniel J. Donovan

[57] ABSTRACT

A tamper-evident container consisting of a molded plastic container, a molded one-piece reclosure lid and a shrink band which prevents access to the contents of the container, in a store environment, without showing visible signs of tampering. The reclosure lid includes a flared skirt which co-acts with the shrink band. The canister and lids are designed to provide primary and secondary nesting means.

7 Claims, 2 Drawing Sheets

TAMPER-EVIDENT CANISTER, LID AND SHRINK BAND ASSEMBLY

TECHNICAL FIELD

This invention relates to a canister, lid and shrink band assembly which is tamper-evident and which provides a hermetic seal between the lid and canister both after initial placement of the lid onto the canister and after repeated removal and replacement of the lid.

BACKGROUND OF THE INVENTION

Plastic canisters and lids with tamper-evident features are known in the art. A great many of these canister and lid assemblies include tear-off strips, usually with the strips constituting the bottom portion of a depending skirt which is located around the perimeter of the lid. Examples of such are disclosed in U.S. Pat. Nos. 4,669,630 to Kenyon and 4,037,748 to Stubbs. It is also know to utilize shrink bands, such as shown in U.S. Pat. No. 4,538,740 to Peterssen, as tamper-evident features on cap and container assemblies.

Instances of product tampering have dictated that sensitive products, such as food and drugs, be packaged in a structure which would make tampering difficult. Unfortunately, the ability to make packaging tamper-proof is more of an ideal than a reality, since tamper-proof packaging which could reasonably be utilized for packaging small quantities of consumer products do not exist. It has, therefore, been an objective to produce tamper-evident packaging, such that it would not be possible to gain access to the contents of a package, in a grocery or other retail store environment, without visibly disrupting the package to such an extent that a reasonable consumer would be aware that the integrity of the package had been breeched. It is a goal of the packaging art to produce tamper-evident packaging which is both effective and economical.

It is an object of this invention to produce reusable plastic canisters and reclosure lids which may effectively be made tamper-evident by means of a shrink band and which canisters and lids, even when fabricated with high-speed molding techniques, are able to effect hermetic seals in virtually all instances. It is a further object of this invention to produce canister, lid and shrink band assemblies which can be vertically stacked to form a column and which have primary and secondary nesting means.

SUMMARY OF THE INVENTION

The present invention relates to a plurality of features which cooperate with each other to produce a tamper-evident plastic canister, plastic reclosure lid and shrink band assembly which is suitable by packaging relatively low-cost products, such as foodstuffs. The plastic canister of this invention is a circular, molded, straight-walled container which terminates at its upper end with a circular rim. The canister is formed from a suitable thermoplastic resin, such as high-density polyethylene, and preferably is formed via injection molding in order to produce a canister body and rim within relatively narrow tolerances. Either the rim itself or a circular ring projects outwardly from the canister wall at or near the top of the canister. This projection forms a peripheral ridge which functions to enable the reclosure lid to snap onto the canister.

The bottom end of the canister terminates in a stepped profile which connects to a circular base having a depressed circular center. This arrangement results in an annular ring forming the bottom surface of the canister (i.e., the surface on which the canister would rest if placed on a flat surface). This annular ring is sized to fit or nest within a U-shaped, depressed, annular channel on the top surface of the reclosure lid. Nesting will occur when the canister and reclosure lid assemblies are stacked, such as would be done on the shelves of retail stores.

The plastic reclosure lid of this invention is a one-piece, non-segmented, circular, molded, skirted lid having a narrow, inverted, U-shaped, upstanding rim at the periphery of the lid. The lid is also formed from a suitable thermoplastic resin, such as high-density polyethylene, and preferably is formed via injection molding in order to produce a part within relatively narrow tolerances. The rim is comprised of inner and outer essentially-vertical sidewalls, a horizontal topwall and an inner channel having a width which is slightly smaller than the width of the canister rim. When the lid is applied to the canister the canister rim is guided to and received by the inner channel of the lid and a hermetic, wedge seal is established by the co-action of the rim and channel.

The skirt of the reclosure lid, which skirt includes the outer sidewall of the rim, possesses an integral, inwardly-extending, circular ring which co-acts with the peripheral ridge of the canister. Upon application of the lid to the canister, the ring on the lid rides over and snaps around the peripheral ridge on the canister. As the reclosure lid snaps onto the peripheral ridge of the canister, an audible signal of closure (e.g., a click) is generated, which indicates to the consumer that a firm or hermetic seal has been formed between the canister and the lid. Snap-on/snap-off features are known in the art as illustrated by U.S. Pat. No. Re. 24,889 to Tupper, U.S. Pat. No. 4,037,748 to Stubbs and U.S. Pat. No. 4,079,857 to Crisci.

The lid skirt of this invention terminates at its bottom end with an outwardly-flared portion such that the diameter at the bottom of the skirt is sized to exceed the outer diameter of the peripheral ridge at the top of the canister. This flared portion of the skirt serves as a guide to aid in mating the canister and lid.

The top surface of the lid is shaped to provide primary and secondary nesting means for stacking lid and canister assemblies. The primary nesting means is provided by the upstanding rim which is sized such that the inner diameter of the inner wall of the upstanding rim is slightly larger than the outer diameter of the annular ring which forms the bottom surface of the canister. The secondary nesting means is comprised of an upwardly-extending shoulder which leads to a raised, ciruclar, horizontal, central area which is at a height slightly above the horizontal topwall of the lid rim. This raised central area is sized to be slightly smaller in diameter than the inner diameter of the annular ring which forms the bottom surface of the canister. The inner wall of the upstanding, U-shaped rim and the shoulder for the raised central area are connected by a horizontal or downwardly sloping transition section.

Preferably, the lid also possesses an annular projection which extends downwardly from the bottom surface of the lid at approximately the junction of transition section and the upwardly-extending shoulder. This annular projection has an inner diameter which is slightly greater than the outer diameter of the raised central area. The annular projection and the raised central area co-act to provide nesting means for stacking the lids prior to mating the lids with the canisters. The ability to nest the lids is desirable in order to minimize the space needed to transport and store the lids as well as to be able to supply the lids to a magazine such as is found on conventional packaging lines.

A circular shrink band is provided around the canister and lid assembly so as to engage both the depending skirt of the lid and the sidewall of the canister. The shrink band may be formed of conventional materials, such as oriented polyethylene film, which will shrink upon the application of heat. In operation, the band would merely be positioned about the lid and canister assembly and then shrunk into place. Due to the fact that the bottom of the skirt is flared outwardly, the shrink band does not have to extend above the top of the upstanding rim on the lid. The fact that the band will shrink around and under the flared skirt will preclude removal and reapplication of the shrink band by a tamperer within a retail store environment. It is desirable from the viewpoint of aesthetics and ability to stack the canister, lid, and shrink band assemblies to avoid having the shrink band extend above and/or around the top of the lid rim. The shrink band could be scored, as is known in the art, such that attempts to remove the band from the canister and lid assembly would produce visible factures on tears in the band. One or more notches could also be present on the top edge of the shrink band in order to facilitate removal of the shrink band. Tearing of the shrink band can be easily initiated at such notches.

DETAILED DESCRIPTION OF THE INVENTION

The features and advantages of the invention will be described in reference to the following detailed description and accompanying drawings.

Figure 1:
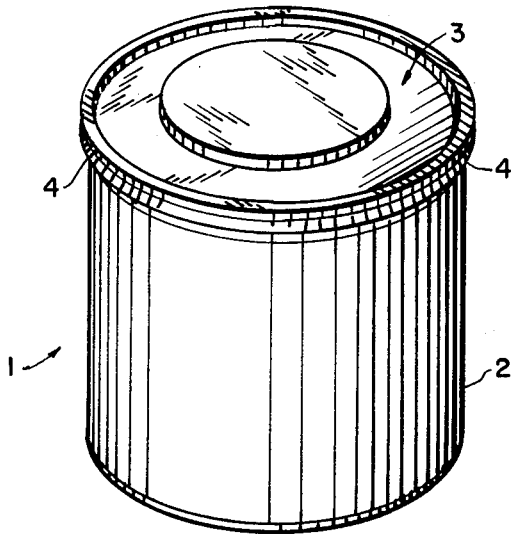
FIG. 1 is a top perspective view of the canister, lid, and shrink band assembly of this invention.
Figure 2:
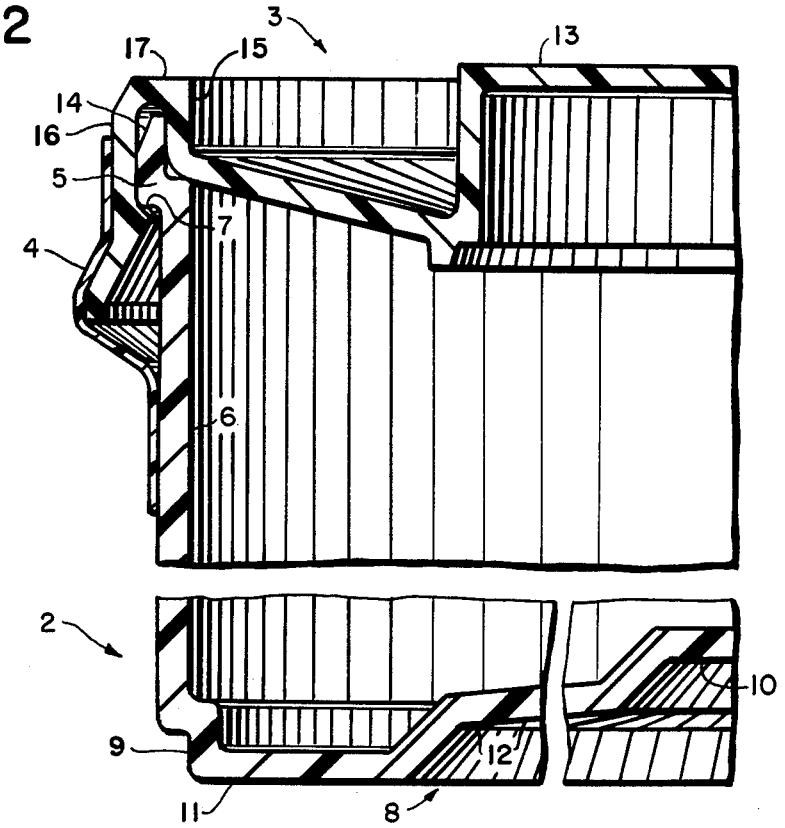
FIG. 2 is a cross-sectional view of the container, lid and shrink band assembly of FIG. 1.

FIG. 1 illustrates the canister, lid and shrink band assembly (1) of the present invention including a circular straight-walled cannister (2), a circular, skirted reclosure lid (3), and a shrink band (4) which engages both a bottom portion of the skirt of lid (3) and a portion of the wall of canister (2). As shown in FIG. 2, canister (2) includes a circular upstanding rim (5) which projects outwardly and upwardly from the canister sidewall (6). The rim (5) includes a ridge (7) which will serve as a means to hold lid (3) in place. The top edge (14) of canister rim (5) is preferably tapered to facilitate mating of the lid and canister.

For the embodiment depicted in FIG. 2 the canister is formed by injection molding, preferably using a mold design wherein the upstanding rim is formed in a chamber with no moving surfaces, in order to give precise control of the rim thickness. Use of a collapsible mold would likely result in a rim surface which is not perfectly smooth and would need to be machined in order to ensure hermetic sealing with reclosure lid (3). Molding of the canister is preferably accomplished by utilizing mold sections which break exteriorly of the canister at a level slightly above ridge (7). In this manner, ridge (7) can be rounded at its bottom corner as opposed to being squared. A rounded ridge will facilitate removal of the lid from the canister. A radius of at least 0.015 inches is useful for this rounded ridge.

Figure 3:
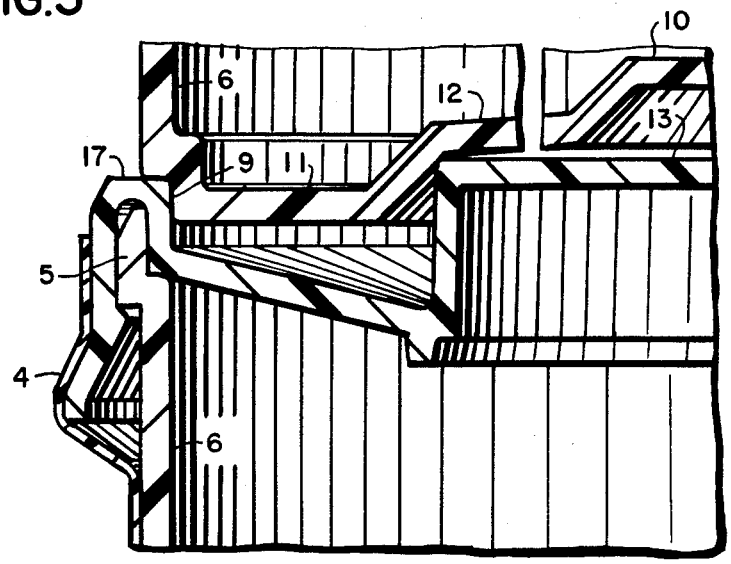
FIG. 3 depicts a partial cross-sectional view of two canister, lid and shrink band assemblies of this invention, stacked upon each other.

The bottom of canister (2) depicts a circular base (8) connected to sidewall (6) by means of inwardly stepped profile (9). Base (8) has a depressed circular center (10) shown here as being lowered on two tiers. The first tier forms an annular ring (11) which constitutes the most bottom surface of the canister. The second tier provides a second annular ring surface (12) and depressed center section (10). Ring (12) will rest against the raised central area (13) of lid (3) when assemblies (1) are stacked. The two-tier arrangement provides added structural stability to maintain the circular shape of the canister and, as shown in FIG. 3, also allows depressed center section (10), which will typically contain the sprue which results from injection molding and/or which could be slightly bowed, to be spaced-apart from lid area (13).

Lid (3) is depicted with an inverted, U-shaped rim (14) which is comprised of inner wall (15), outer wall (16) and an essentially horizontal top wall (17). These walls define an inner channel (18) which receives canister rim (5). The width of channel (18) is preferably at least 0.005 inches narrower than the thickness of canister rim (5). The lid is preferably injection molded with the internal channel (18) being formed around a standing metal ring in order to give precise control of the channel width which in turn will ensure a hermetic-seal with the canister rim.

Outer rim wall (16), which also constitutes the skirt of the lid, terminates in an outwardly-flared section (19). The inner surface of wall (16) carries an integral ring (20) which is shown to co-act with canister ridge (7). Preferaby, the upper surface (21) of ring (20) is angled downwardly at about a 45° angle from horizontal. If this angle is much less than 45°, it will be difficult to remove the lid from the canister. If the angle is considerably greater than 45°, the lid does not adequately snap onto the canister. Channel (18), as measured from its top to ring (20), is longer than canister rim (5) in order to provide some margin for tolerance. As will be appreciated by those skilled in the art, the seal which is formed between the lid and the canister is soley a function of friction-mating of canister rim (5) within lid channel (18).

Figure 4:
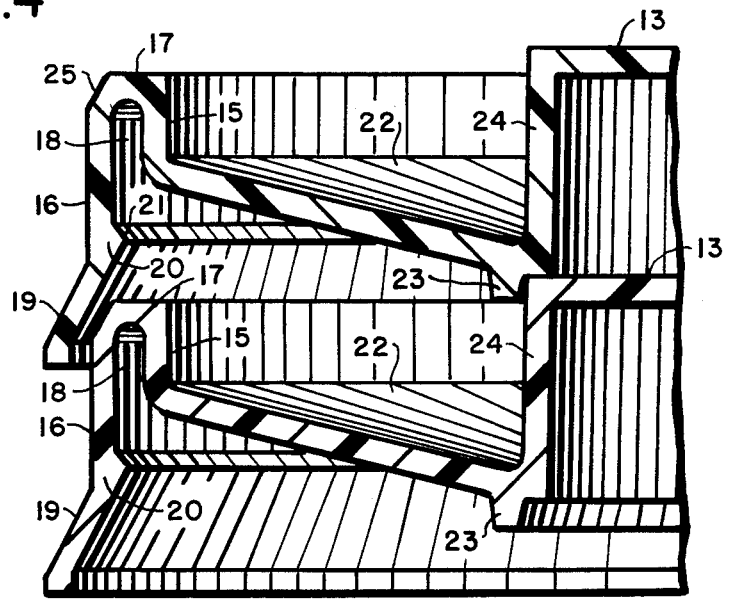
FIG. 4 is a cross-sectional view of two reclosure lids of this invention, stacked upon each other.

Lid (3) is depicted as having the raised central area (13) supported or carried by shoulder means (24). Shoulder means (24) is shown as being vertical but could as well be tapered inwardly. Tapering may be useful to facilitate the molding operation. Shoulder means (24) is connected to inner wall (15) of the lid rim by means of transition section (22). This section (22) is depicted as downwardly sloping but could as well be horizontal. The bottom surface of the lid carries an integral annular projection (23) which, as shown in FIG. 4, provides a means for effecting nesting of the lids. The presence of flared skirt section (19) along with slanted surface (25) facilitates stacking of the lids. As shown in the drawings slanted surface (25) connects the horizontal top wall (17) of the lid rim with the outer wall (16) of the lid rim.

As noted above, shrink band (4) engages outer wall (16) of the lid rim, including flared section (19), and the canister side wall (6). Shrinkage of band (4) around flared section (19) and onto canister side wall (6) will preclude efforts to remove the shrink band by merely trying to slip the shrink band off the canister-lid assembly.

Having thus described the invention, what is claimed is:

1. A tamper-evident plastic canister, plastic reclosure lid and shrink band assembly comprised of:

(a) a circular, molded thermoplastic straight-walled canister which terminates at its upper, open end with a circular rim and which terminates at its bottom end with an inwardly stepped profile which is connected to a circular base, said base having a depressed, circular center and an outer annular ring which ring forms the most bottom surface of the canister, said annular ring having inner and outer diameters similar, but slightly smaller than a generally U-shaped, annular channel depressed in the top surface of a matched reclosure lid, and said canister having a peripheral ridge located at or near the top of the canister which ridge extends outwardly from the canister wall;

(b) a one-piece, non-segmented, molded, flexible, thermoplastic reclosure lid having a continuous, depending skirt and an inverted U-shaped upstanding rim around the lid periphery, said rim being comprised of inner and outer side walls, a horizontal top wall and an internal channel which is sized smaller than the thickness of the rim of the canister and which co-acts therewith to form a hermetic wedge seal upon application of lid onto the cannister rim;

(c) said lid skirt shaped to receive and secure itself to the container rim by means of an integral and inwardly-extending circular ring which co-acts to form a lock with the peripheral ridge of the canister and wherein said outer skirt wall terminates at its bottom end with an outwardly-flared section sized to exceed the outer diameter of the canister rim and the canister peripheral ridge, said flared portion forming a guide to aid in mating the canister and lid;

(d) said inner wall of the U-shaped, upstanding rim being sized slightly larger than the outer diameter of the annular ring which forms the bottom surface of the canister in order to provide a primary nesting means when stacking lidded canisters;

(e) said lid containing on its upper surface a shoulder which provides a secondary nesting means to co-act with the canister bottom, said secondary nesting means being comprised of a raised, circular, horizontal, central area, which area is at a height slightly above the top of the U-shaped rim, and a horizontal, or downwardly sloping transition section connecting the inner wall of the U-shaped upstanding rim and said shoulder and wherein said raised central area is sized to be slightly smaller in diameter than the inner diameter of the annular ring which forms the bottom surface of the canister; and (f) a circular shrink band which is shrunk to engage the depending skirt of the plastic lid, including said outwardly-flared section, and the side wall of the canister such that the reclosure lid cannot be removed from and replaced on the canister without evidencing visible signs of tampering, said shrink band being positioned so as not to extend above or over the horizontal top wall of the U-shaped rim.

2. The tamper-evident canister, lid and shrink band assembly of claim 1 wherein both the canister and lid are injection molded pieces.

3. The tamper-evident canister, lid and shrink band assembly of claim 2 wherein the canister rim projects outwardly and upwardly from the canister side wall and constitutes said peripheral ridge.

4. The tamper-evident canister, lid and shrink band assembly of claim 3 wherein the peripheral ridge is rounded at its bottom corner.

5. The tamper-evident canister, lid and shrink band assembly of claim 2 wherein the depressed circular center of the canister base is lowered on two tiers to provide two annular ring surfaces.

6. The tamper-evident canister, lid and shrink band assembly of claim 2 wherein the upper surface of the circular ring which extends inwardly from the lid skirt is angled downwardly at about a 45° angle.

7. The tamper-evident canister, lid and shrink band assembly of claim 1 wherein the bottom surface of the lid carries an integral annular projection located at the junction of said transition section and said shoulder, said projection having an inner diameter slightly greater than the outer diameter of horizontal, central area of the lid and said projection providing nesting means for stacking the lids.

* * * * *